US010647469B2

(12) United States Patent
Steiger

(10) Patent No.: US 10,647,469 B2
(45) Date of Patent: May 12, 2020

(54) CONTAINER SYSTEM WITH MULTIPLE STORAGE COMPARTMENTS

(71) Applicant: Christopher J Steiger, Henderson, NV (US)

(72) Inventor: Christopher J Steiger, Henderson, NV (US)

( * ) Notice: Subject to any disclaimer, the term of this patent is extended or adjusted under 35 U.S.C. 154(b) by 0 days.

(21) Appl. No.: 16/005,675

(22) Filed: Jun. 11, 2018

(65) Prior Publication Data

US 2019/0375541 A1 Dec. 12, 2019

(51) Int. Cl.

| | |
|---|---|
| ***B65D 8/00*** | (2006.01) |
| ***B65D 6/24*** | (2006.01) |
| ***B65D 43/02*** | (2006.01) |
| ***B65D 23/10*** | (2006.01) |
| ***B65D 21/08*** | (2006.01) |

(52) U.S. Cl.

CPC ..... *B65D 11/04* (2013.01); *B65D 11/1866* (2013.01); *B65D 21/083* (2013.01); *B65D 23/106* (2013.01); *B65D 43/0212* (2013.01)

(58) Field of Classification Search

USPC ..... 220/23.86, 23.87, 23.88, 500–557

See application file for complete search history.

(56) References Cited

U.S. PATENT DOCUMENTS 2,326,414 A * 8/1943 Thompson ..... B65D 7/00 220/4.27
3,997,072 A * 12/1976 Guth ..... B65F 1/06 220/324
4,778,068 A * 10/1988 Kohus ..... A61J 9/00 215/11.1
4,931,329 A * 6/1990 Sun ..... B29C 66/543 428/36.92
5,095,579 A * 3/1992 Becker ..... A47L 9/00 15/264
5,154,303 A * 10/1992 Jordan ..... B25H 3/06 206/506
5,558,254 A * 9/1996 Anderson ..... B65F 1/0053 220/23.86
6,116,439 A * 9/2000 Yaniv ..... B65D 11/04 215/10
7,059,477 B2 * 6/2006 Wolf, II ..... B65D 11/04 209/373
8,028,847 B2 * 10/2011 Klaver ..... A61J 9/00 215/11.1
8,342,346 B2 * 1/2013 Rances ..... B65D 21/083 220/23.83
8,342,349 B2 * 1/2013 Lu ..... A47J 41/00 206/508
8,875,928 B1 * 11/2014 Bennett ..... B65D 11/04 215/11.3
9,415,885 B2 * 8/2016 Py ..... B65B 3/003
9,751,685 B2 * 9/2017 Sebben ..... B65D 21/0228
2002/0074334 A1 * 6/2002 Karp ..... A47G 19/2205 220/212

* cited by examiner

*Primary Examiner* — Kareen K Thomas
(74) *Attorney, Agent, or Firm* — Newman Law, LLC

(57) ABSTRACT

A container system comprising a hollow body defined by a continuous outer peripheral wall having a first cavity and a second cavity opposing the first cavity and separated by a dividing wall, a neck opening into the first cavity and a wider open mouth at the end opposing the neck for receiving a base container therein having a lid that engages the inner surface of the outer peripheral wall to secure the base container in the mouth and substantially seal the second cavity.

1 Claim, 5 Drawing Sheets

CONTAINER SYSTEM WITH MULTIPLE STORAGE COMPARTMENTS

CROSS REFERENCE TO RELATED APPLICATION(S)

This application claims the benefit of U.S. Provisional Patent Application No. 62/517,345 which was filed Jun. 9, 2017, the disclosure of which is incorporated herein by reference.

FIELD OF THE INVENTION

The invention relates to devices and containers configured to contain liquid beverages and food, liquid food beverages and other foodstuffs, and systems, devices and methods of manufacturing and assembling same.

BACKGROUND OF THE INVENTION

Fitness has never been more prominent than it is today. Individuals therefore understand that maintaining a healthy lifestyle involves exercise among other things. While the act of exercising is important, it is also important that the exercising be accomplished in a healthy manner including the intake of fluids to prevent dehydration and ingestion of comestibles. However, carrying liquids and food while exercising and maintaining these items at a desired temperature can be challenging. Moreover, keeping track of multiple containers can be burdensome and difficult to carry and transport.

SUMMARY OF THE INVENTION

The invention is directed to a container system which addresses and resolves the above-described issues, by among other things, in some embodiments, disclosing systems and devices for containing liquid beverages and other liquid or non-liquid food, and system and methods of manufacturing and assembling same.

The invention is generally directed to a container system comprising a hollow body defined by a continuous outer peripheral wall having a first cavity and a second cavity opposing the first cavity and separated by a dividing wall, a neck opening into the first cavity and a wider open mouth at the end opposing the neck for receiving a base container therein having a lid that engages the inner surface of the outer peripheral wall to secure the base container in the mouth and substantially seal the second cavity.

In some embodiments, the first cavity is configured to store fluids and includes a features for creating a non-permanent seal of the first cavity, such as a spout having outer surface threading for receiving a cap with corresponding threading thereon. Upon being sealed, the first cavity is rendered impervious to fluid leakage. The second cavity is configured to receive at least one rigid body therein, which may be a container or ice pack, and includes a feature for creating a non-permanent engagement with the rigid body to maintain the rigid body within the second cavity until the non-permanent engagement is disengaged. The non-permanent engagement may be a latching mechanism which latches onto the rigid body, a snap fit between a rigid body and the interior of the second cavity, or a flexible article securing the opening of the second cavity, for example.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of a container system and devices.

DESCRIPTION OF THE INVENTION

Figure 1:
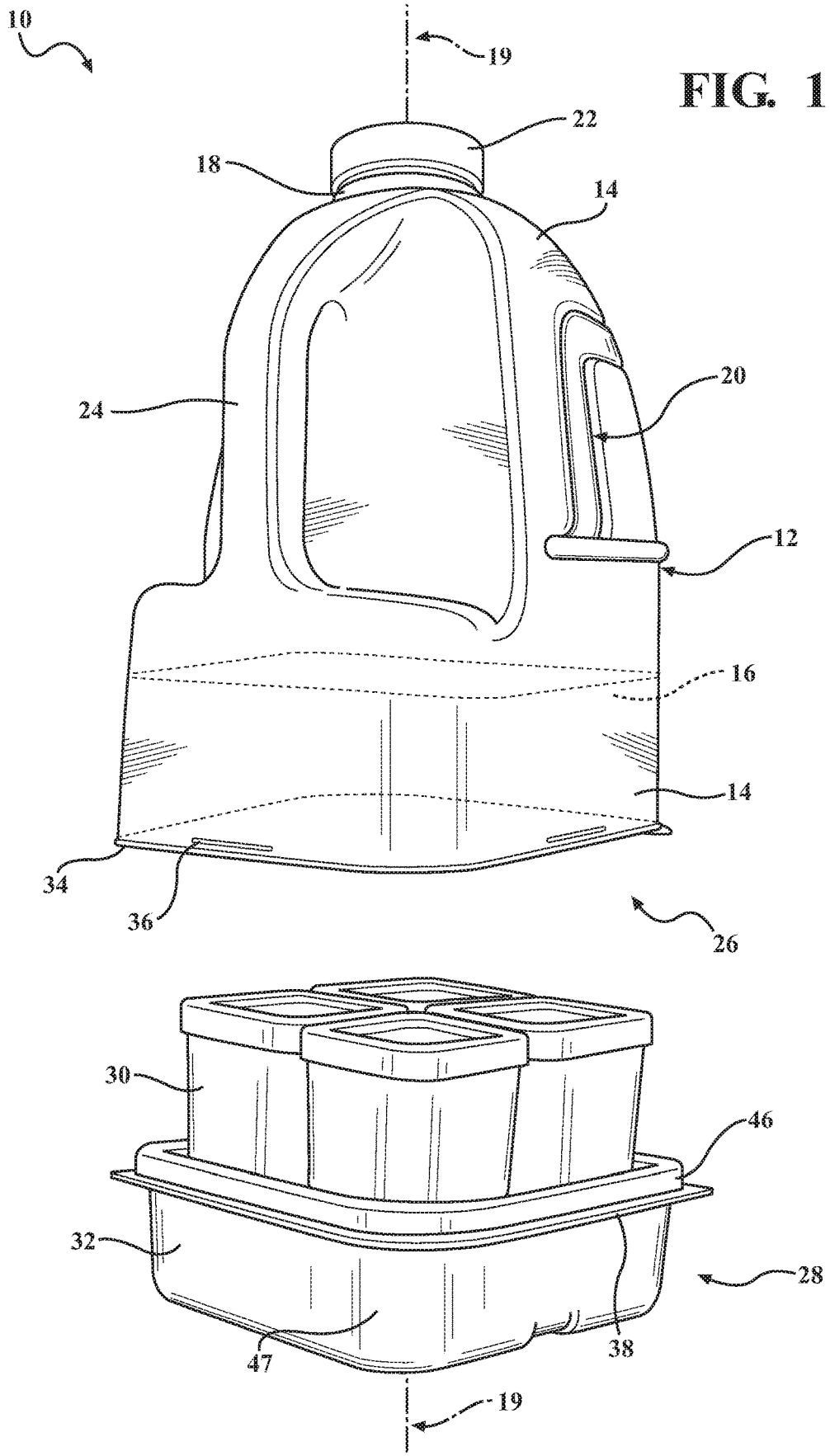
FIG. 1 illustrates a first embodiment of a container system of the invention.

The embodiments of the invention disclosed below are directed toward systems and devices for containing liquid beverages and liquid or non-liquid foods, and system and methods of manufacturing and assembling same. The principles of the invention, however, are not limited to such systems and devices. It will be understood that, in light of the invention, the systems and devices disclosed herein can be successfully used in connection with other types of containers, bottles, vessels, decanters, pitchers, receptacles and the like.

For the purposes of promoting an understanding of the principles in accordance with the embodiments of the present invention, reference will now be made to the embodiments illustrated in the drawings and specific language will be used to describe the same.

To assist in the description, words indicating direction and location, such as vertical, horizontal, top, bottom, below, above, front, rear, right and left may be used to describe elements of the invention shown in the accompanying figures. It will be appreciated, however, that the invention can be located in a variety of desired positions, including various angles, sideways and even upside down, and it will nevertheless be understood that no limitation of the scope of the invention is intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 illustrates an exemplary embodiment of the invention identified as container system 10 or just container 10 hereinafter. Container 10 includes a unitary body 12 having a continuous outer wall 14, an interior dividing wall 16 and a neck 18. Neck 18 enables fluid ingress into and egress from a first cavity 20. Neck 18 is threaded on its exterior surface which facilitates mating with cap 22 having similar threading on its interior circumference. A handle 24 is defined on a portion of outer wall 14.

Outer wall 14 extends transversely with respect to dividing wall 16 to further define a second cavity 26 opposing first cavity 20. In some embodiments, dividing wall 16 is substantially perpendicular with respect to outer wall 14. While body 12 is generally shaped in the form of a gallon jug, and made of a generally inflexible and non-deformable material, those skilled in the art will recognize that the article herein may be fabricated of other materials for other shapes of other volumes and/or sizes.

Container 10 also includes a set of bodies 28, which may be rigid, non-deformable or soft bodies including, in this embodiment, four containers 30 which are substantially the same size and a base container 32. In this embodiment, each container 30 is smaller than base container 32, however, all four containers 30 may be arranged in a grid that has length and width profile that is substantially the same as the length and width profile of base container 32. Each container shown herein includes an opening which may be closed, such as a top part or cover and a bottom part. For example, base container 32 includes top part or lid 46 and a bottom part 47 which are configured to form a non-permanent engagement with one another thus sealing liquid or non-liquid food therein.

A surrounding rim 34 is defined about outer wall 14 at the end of body 12 opposing the end of body 12 with neck 18. Rim 34 surrounds an opening to second cavity 26. Cavity 26 and bodies 28 are configured and dimensioned to be inserted in second cavity 26. In this embodiment, base container 32 is configured and dimensioned such that top 46 can be inserted into cavity 26 with bottom 47 extending below rim 34, axially with respect to the vertical axis 19 formed by neck 18. Bottom 47 may have a flat surface area or other features forming legs or contact points which support body 12 in a standing position when placed on another surface without body 12 tipping over. In this embodiment, rim 34 is also configured to support body 12 in standing position when placed on another surface without body 12 tipping over. In this embodiment, rim 34 extends to the same axial plane relative to the axis 19 formed by neck 18 in sufficient positions or contact points to balance body 12 in an upright position.

Rim 34 and/or one or more bodies 28, further include engagement features for creating a non-permanent engagement to secure and maintain bodies 28 within second cavity 26. For example, the non-permanent engagement features may include features, such as a latch on rim 34 which secures base container 32. Base container 32 may thus be secured in rim 34 with containers 30 placed axially above base container 32 within second cavity 26. Containers 30 or other bodies 28, including items such as bagged goods, dry-ice or other cooling agents, rest upon or contact top 46 of base container 32 and are maintained in cavity 26 by contact with the upper surface of top 46 and contact with or otherwise being enclosed within the inner surfaces of wall 14 and dividing wall 16.

In some embodiments, lid or top 46 of base container 32 and/or rim 34 may include snap fitting features such as one or more inner protruding lips 36 defined on the inside surface of wall 14 within second cavity 26 and an outer protruding rim 38 defined on lid 46 of container 32. In this embodiment, outer rim 38 engages with lips 36 by rim 38 being pushed upward axially over lips 36 and into cavity 26. Lips 36 prevent base container 32 from being removed axially downward from within cavity 26 by requiring first overcoming the physical resistance caused by contact between lips 36 and rim 38. The resistance holds base container 32 and thereby containers 30 or other any other bodies 28 positioned between base container 32 and dividing wall 16 within second cavity 26 until sufficient downward force is applied to disengage the snap fit engagement between inner lip 36 and outer rim 38. Alternatively, or in combination therewith, force may be applied to rim 34 in some embodiments where wall 14 is constructed of a resilient yet temporarily and slightly deformable material such as plastic, thus releasing container 32 from within second cavity 26.

In use, top 46 and bottom 47 of base container 32 are secured to each other. Base container 32 can be placed on a surface and bodies 28 placed on the upper surface of top 46. Body 12 may then be placed over the top of the bodies 28 and, provided that bodies 28 will fit within the volume of cavity 26, moved downward until either an engagement is or can be formed with base container 32. For example, the engagement may be automatically formed by rim 38 passing over lips 36 or an engagement may be formed by securing a latch such as those disclosed herein. In the embodiments disclosed herein, bottom 47 of base container 32 may be of any size or shape so long as lid 46 is capable of being engaged to body 12. For example, bottom 37 may be circular or deeper than shown, provided that lid 46 includes an outer rim 38 which contacts lips 36 to maintain base container 32 in place and restrain any bodies 28 from falling out of cavity 26.

Figure 2:
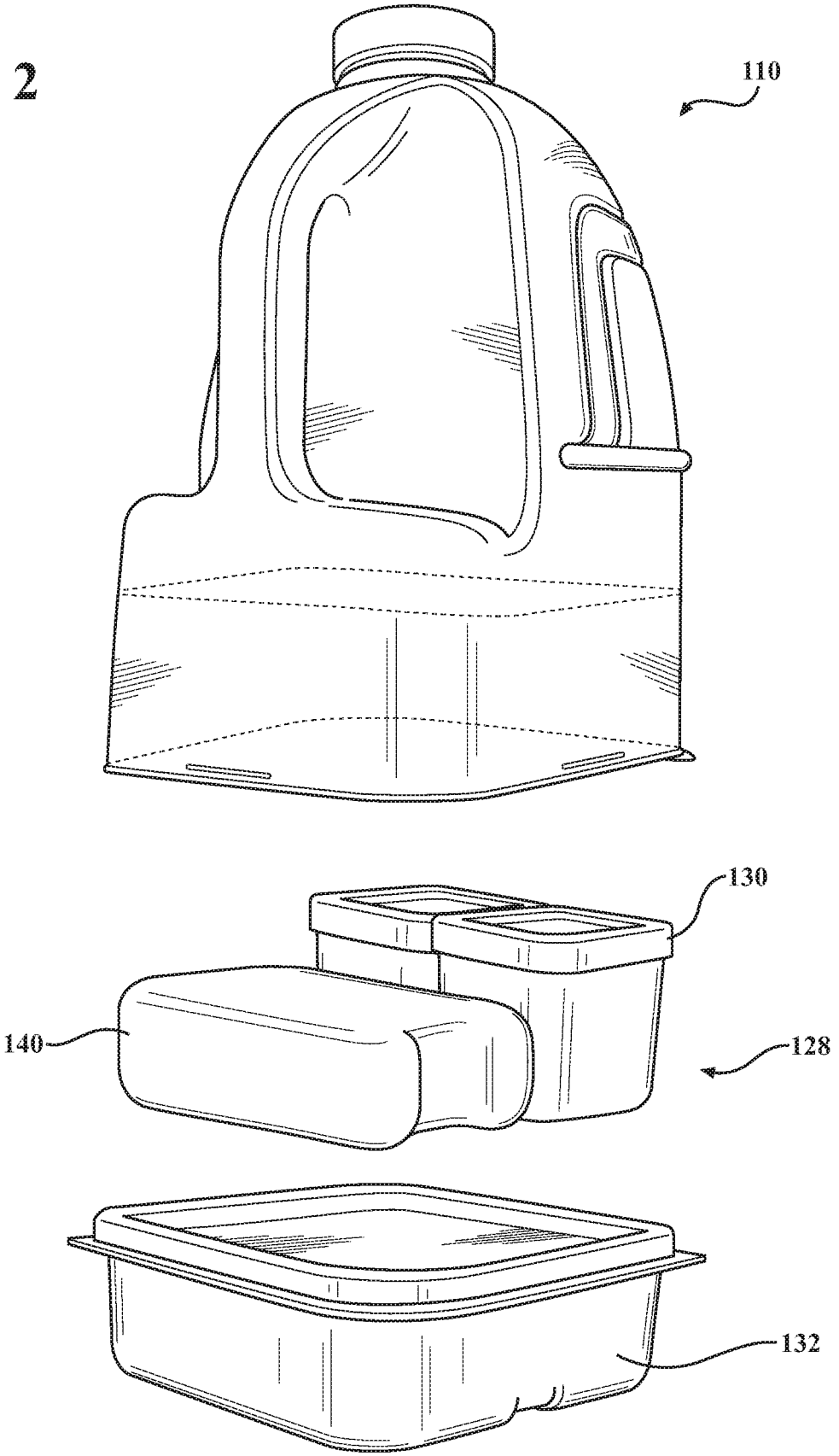
FIG. 2 illustrates a second embodiment of a container system of the invention.
Figure 3:
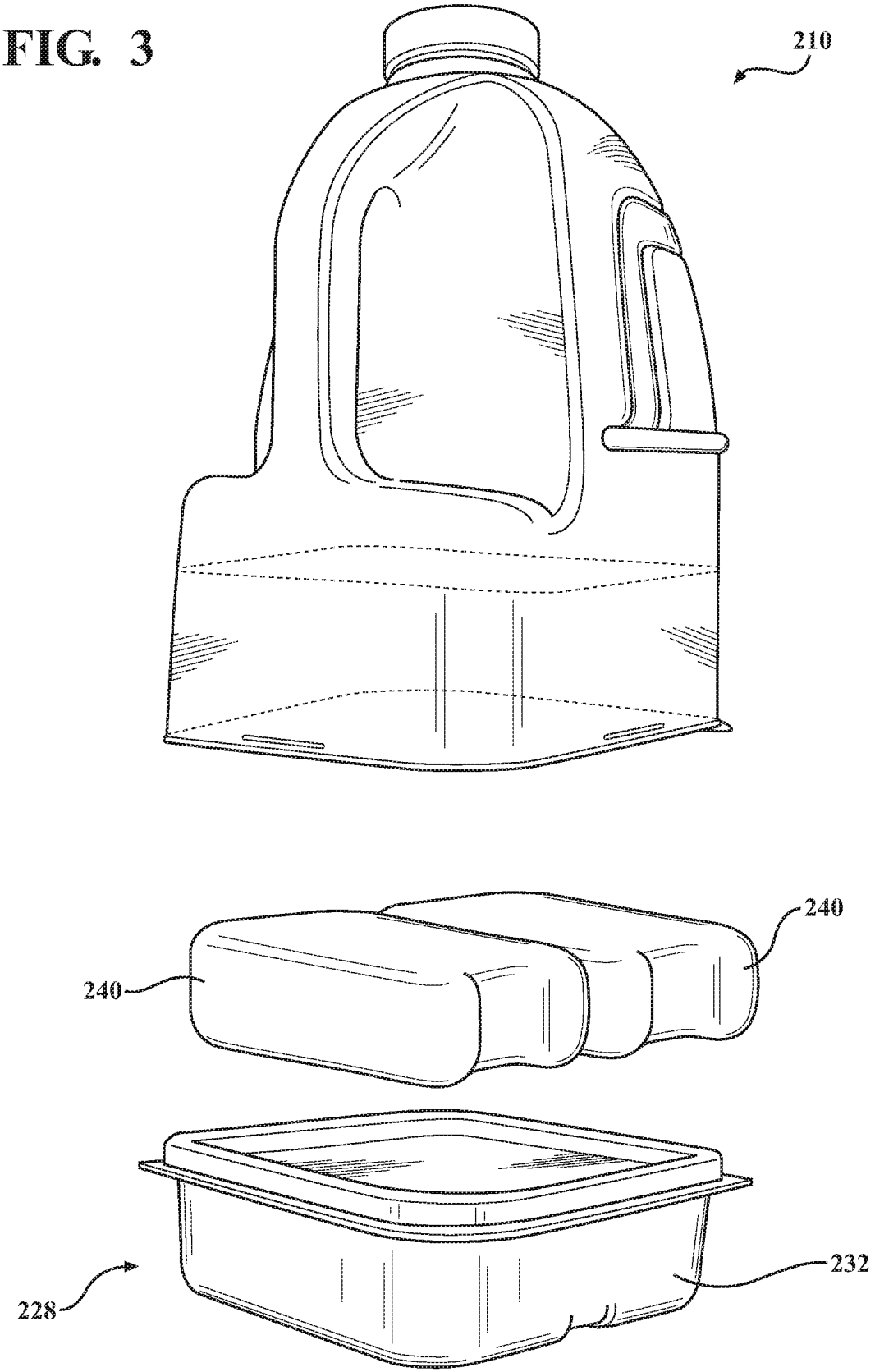
FIG. 3 illustrates a third embodiment of a container system of the invention.

FIGS. 2 and 3 illustrate various exemplary embodiments of the invention. In FIG. 2, the rigid bodies 128 of container system 110 include 2 containers 130, one container 132 and a reusable ice pack 140. In FIG. 3, container system 210 includes rigid bodies 228 which include one container 232 and two reusable ice packs 240. In each of these embodiments, the exemplary engagement features of the invention as shown in FIG. 1, that is the snap fit engagement between container 132 and 232, and the respectively are used in the same manner in FIGS. 2 and 3.

Figure 4:
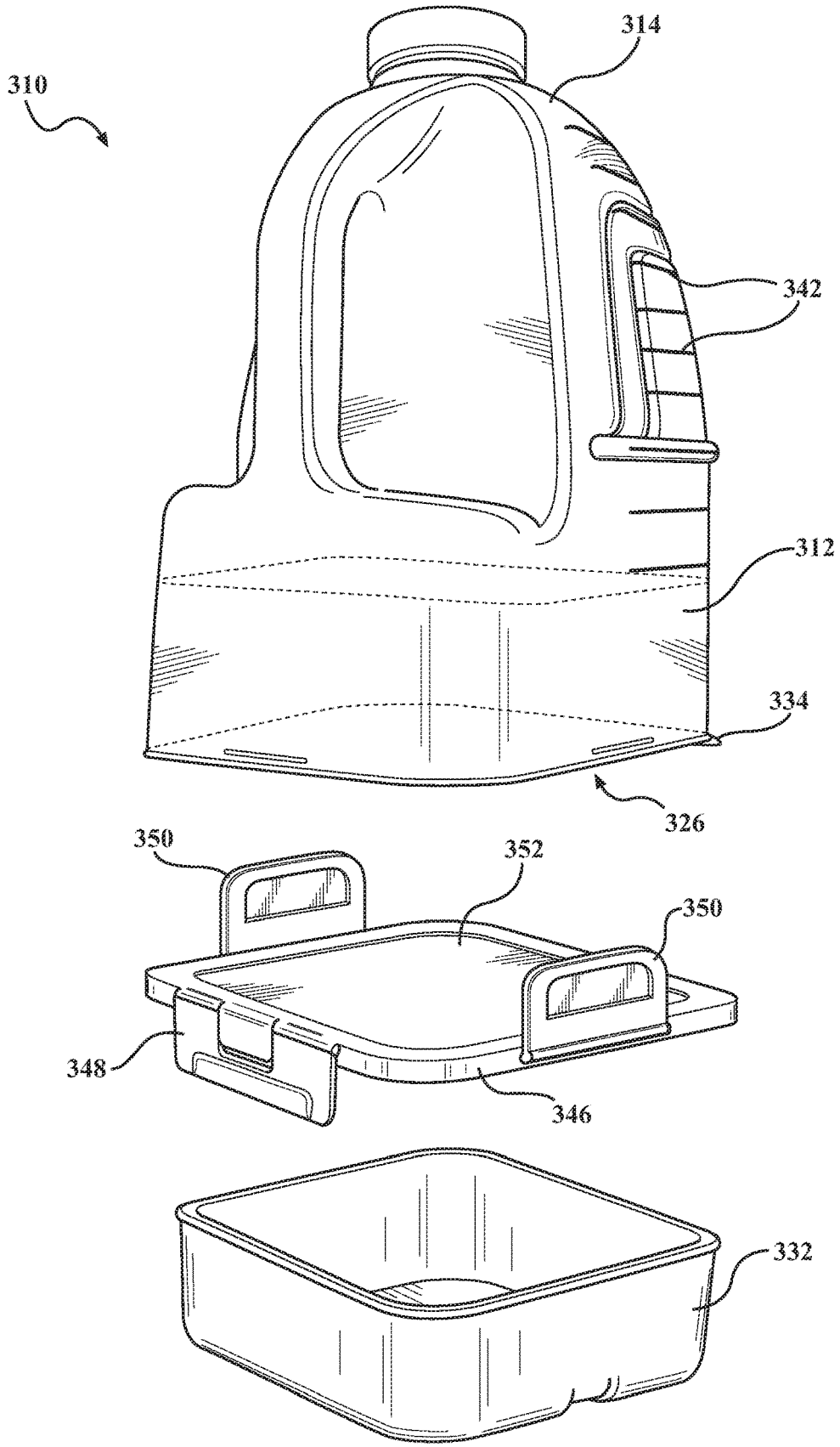
FIG. 4 illustrates a fourth embodiment of a container system of the invention.
Figure 5:
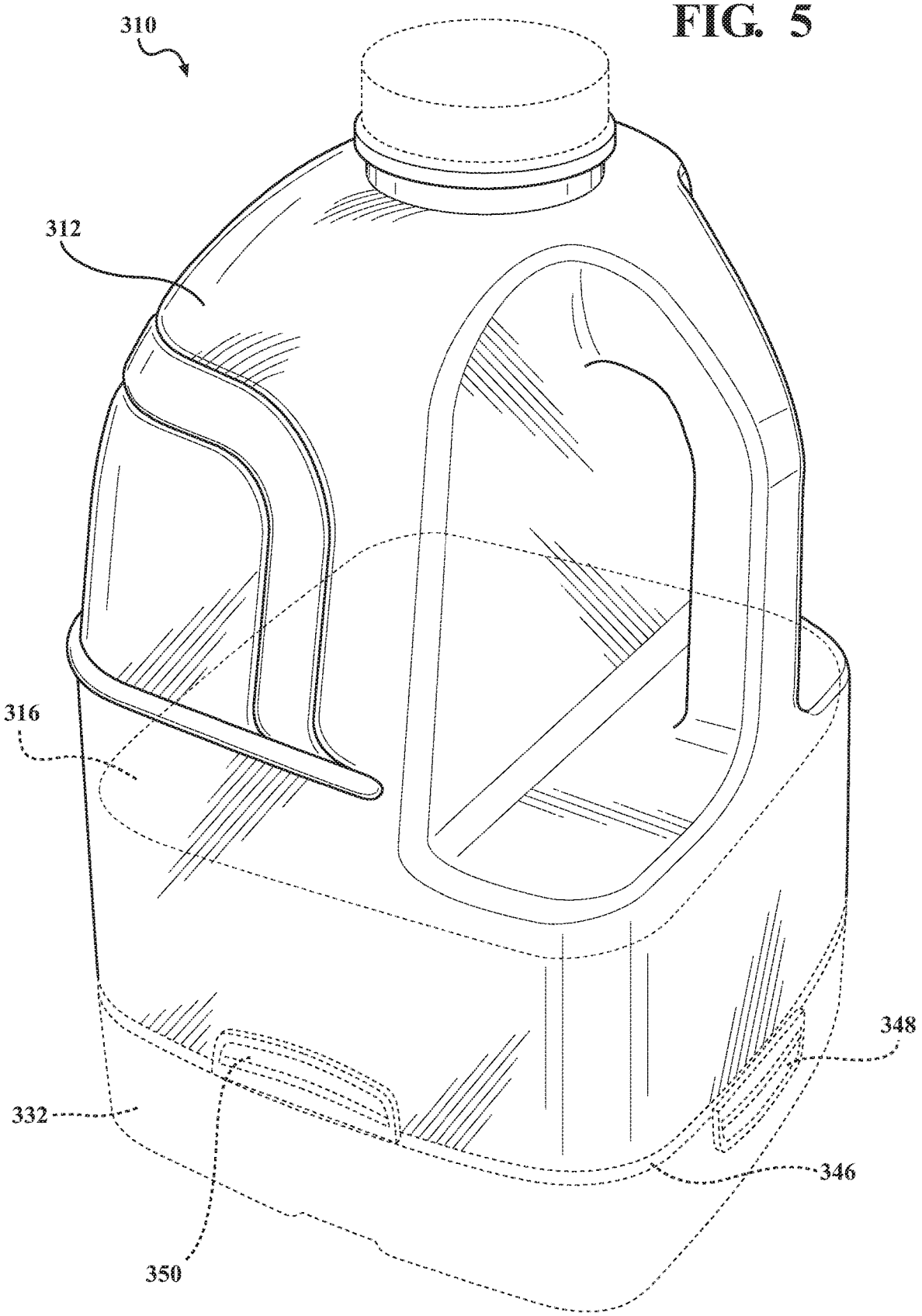
FIG. 5 illustrates the fourth embodiment of a container system of the invention, with the base container secured in the body of the container.

FIGS. 4 and 5 illustrate another exemplary embodiment of the invention referred to by the numeral 310 which includes visible marks or grooves 342 in outer wall 314 of body 310 for measuring liquid consumption from cavity 320. A container 332 includes a lid 346 having pivoting sealing members 348 for sealing container 332 and pivoting sealing members 350 for engagement with the interior wall of second cavity 326 to facilitate securing container 332 and any ice packs or other containers seated on the upper surface 352 of lid 346.

The container system, including the rigid containers, may be constructed of a food-grade plastic or acrylic material, which may be semi-transparent or transparent materials. As shown by the exemplary figure and pictures also provided herein. It should be understood that the aforementioned embodiments of the invention may be of any size or shape.

Suitable methods, apparatus, and materials for making or processing containers, including both c, as disclosed herein include, but are not limited to, those described in U.S. Pat. Nos. 6,312,641, 6,676,883, and 6,136,441 all of which are incorporated by reference herein in their entireties.

The starting material for several methods of construction includes extruded sheet stock. Sheet stock may have mono- or multi-layer construction, and may include an active or passive barrier or other functionality, such as UV absorbance. Extruded sheet can be delivered to a molding apparatus from one or more systems (e.g., standard, traditional or custom systems, etc.). Prior to forming, the sheet stock may be cleaned and/or sterilized by one or more methods, such as, for example, steam, hydrogen peroxide, other chemical or physical treatments, UV, flame, gamma ray, plasma treatments and/or the like.

In certain embodiments, thermoforming is used to mold all or portions of the container system of the invention. Any form of thermoforming can be used. For example, manufacturing methods can include a combination of vacuum, mandrel assist and/or pressure forming of cylindrical or differently shaped containers.

The articles disclosed herein may be made from any of a wide variety of materials. In addition, the thermoforming and other types of methods, systems, apparatuses and devices disclosed herein can be configured to form containers and other items using some or all of the materials discussed herein. Although some articles may be described specifically in relation to one or more particular materials, these same articles, and the methods used to make the articles are applicable to many other thermoplastics including, but not limited to, polyesters, polyolefins, polylactic acid, polycarbonate, and the like. Other suitable materials include, but are not limited to, polymeric materials, including thermoset polymers, thermoplastic materials such as polyesters, polyolefins, including polypropylene and polyethylene, polycarbonate, polyamides, including nylons (e.g. Nylon 6, Nylon 66) and MXD6, polystyrenes, epoxies, acrylics, copolymers, blends, grafted polymers, and/or modified polymers (monomers or portion thereof having another group as a side group, e.g. olefin-modified polyesters). These materials may be used alone or in conjunction with others in multi-layer structures, blends or copolymers, and can also be combined with different additives, such as nanoparticle barrier materials, oxygen scavengers, UV absorbers, foaming agents and the like. More specific material examples include, but are not limited to, ethylene vinyl alcohol copolymer (EVOH), ethylene vinyl acetate (EVA), ethylene acrylic acid (EAA), linear low density polyethylene (LLDPE), polyethylene 2,6- and 1,5-naphthalate (PEN), polyethylene terephthalate glycol (PETG), poly(cyclohexylenedimethylene terephthalate), polylactic acid (PLA), polycarbonate, polyglycolic acid (PGA), polystyrene, cycloolefin, poly-4-methylpentene-1, poly(methyl methacrylate), acrylonitrile, polyvinyl chloride, polyvinylidine chloride (PVDC), styrene acrylonitrile, acrylonitrile-butadiene-styrene, polyacetal, polybutylene terephthalate, polymeric ionomers such as sulfonates of PET, polysulfone, polytetra-fluoroethylene, polytetramethylene 1,2-dioxybenzoate, polyurethane, and copolymers of ethylene terephthalate and ethylene isophthalate, and copolymers and/or blends of one or more of the foregoing.

In certain embodiments materials may be virgin, preconsumer, post-consumer, regrind, recycled, and/or combinations thereof. One or more layers which form a cup may include one or more additives. Additives preferably provide functionality to the cup (e.g. UV resistance, barrier, scratch resistance). A polymeric material used in a layer composition may, itself, provide functional properties such as barrier, water resistance, and the like. Other functionality provided by one or more layers, alone or together with other functionality, include color, including but not limited to dyes and pigments, adhesion promoters, improved water vapor barrier, lubricity, including from natural or man-made lubricants, including waxes such as carnauba and paraffins, and abrasion resistance.

The various methods and techniques described above provide a number of ways to carry out the invention. Of course, it is to be understood that not necessarily all objectives or advantages described may be achieved in accordance with any particular embodiment described herein.

Furthermore, the skilled artisan will recognize the interchangeability of various features from different embodiments. Similarly, the various features and steps discussed above, as well as other known equivalents for each such feature or step, can be mixed and matched by one of ordinary skill in this art to perform methods in accordance with principles described herein.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein and equivalents thereto.

The invention claimed is:

1. A container system comprising:

a hollow body defined by a continuous outer peripheral wall having a first cavity and a second cavity, the first cavity defining a first storage space and the second cavity opposing the first cavity, the first cavity and second cavity being separated by a rigid dividing wall, a neck defined by the hollow body, the neck providing an opening into the first cavity, a wider open mouth defined by the hollow body at the end of the hollow body opposing the neck, the open mouth being dimensioned for receiving a base container therein having a lid, the lid forming an engagement with the inner surface of the outer peripheral wall to secure the base container in the open mouth and substantially seal the second cavity, wherein the base container having a lid defines a second storage space, the second storage space being independent from the first storage space.

* * * * *